US006254665B1

(12) United States Patent
Matsushita et al.

(10) Patent No.: US 6,254,665 B1
(45) Date of Patent: Jul. 3, 2001

(54) METHOD FOR PRODUCING REDUCED IRON AGGLOMERATES

(75) Inventors: Koichi Matsushita, Tokyo; Masataka Tateishi, Kakogawa; Hidetoshi Tanaka, Kakogawa; Takao Harada, Kakogawa, all of (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/429,111

(22) Filed: Oct. 28, 1999

(30) Foreign Application Priority Data

Apr. 11, 1998 (JP) ..... 10-313202

(51) Int. Cl.[7] ..... C21B 11/00; C21B 13/00

(52) U.S. Cl. ..... 75/484; 264/30; 266/177; 266/281

(58) Field of Search ..... 75/484; 266/281, 266/177; 264/30

(56) References Cited

U.S. PATENT DOCUMENTS 3,378,242 4/1968 Cone et al. .
3,443,931 5/1969 Beggs et al. .
3,452,972 7/1969 Beggs .
5,186,741 2/1993 Kotraba et al. .
5,730,775 * 3/1998 Meissner et al. ..... 75/484

FOREIGN PATENT DOCUMENTS 36 17 205 2/1987 (DE) .
37 35 569 5/1988 (DE) .
5-125454 5/1993 (JP) .

OTHER PUBLICATIONS

Steel Handbook, 3rd Ed.. Sep. 20, 1980, JAPAN, II Pig iron making • steel making.

* cited by examiner

*Primary Examiner*—Melvyn Andrews
(74) *Attorney, Agent, or Firm*—Oblon, Spivak, McClelland, Maier & Neustadt, P.C.

(57) ABSTRACT

A moving hearth is formed by providing a layer of hearth material primarily composed of iron oxide on a base refractory in a reducing furnace and then sintering the hearth material so that the sintered moving hearth is not melted at an operational temperature in a reducing step. The moving hearth is more easily constructed compared to providing a shaped or amorphous refractory on the base refractory, has high durability, and can maintain surface flatness during operation.

7 Claims, 3 Drawing Sheets

METHOD FOR PRODUCING REDUCED IRON AGGLOMERATES

BACKGROUND OF THE INVENTION

1. Field of the Invention

The present invention relates to a method for producing reduced iron agglomerates by reduction of iron oxide agglomerates incorporated with carbonaceous material in a moving hearth reducing furnace.

2. Description of the Related Art

In a MIDREX process, which is known as a method for preparing reduced iron, a reducing gas produced by degeneration of natural gas is blown into a shaft furnace through a tuyere so that the iron ore or iron oxide pellets filled in the furnace are reduced in a reducing atmosphere. This method uses a large amount of natural gas, which is expensive, and requires degeneration of the natural gas. Thus, this method inevitably results in high production costs.

Recently, processes for producing reduced iron using inexpensive coal in place of the natural gas have attracted attention. For example, U.S. Pat. No. 3,443,931 discloses a process for producing reduced iron including pelletizing a mixture of powdered iron ore and a carbonaceous material, such as coal, and reducing iron oxide in a hot atmosphere. In this process, a given depth of iron oxide pellets incorporated with a dried carbonaceous material is fed into a rotary hearth furnace. The contents are moved and heated by radiant heat in the furnace to reduce iron oxide by the carbonaceous material. The reduced pellets are cooled by radiative cooling and are then discharged from the furnace by a discharging apparatus. This process has some advantages over the MIDREX process: use of coal as a reducing agent, direct use of powdered iron ore, and a high reducing rate.

Rolling, friction or dropping shock when the iron oxide pellets are fed into the reducing furnace, however, causes formation of powder from the pellets and the powder is fed into the furnace together with the pellets. The fed powder is deposited on the rotary hearth. Since the powder also includes the carbonaceous material, it is reduced together with the iron oxide pellets to form reduced iron powder. A fraction of the reduced iron is discharged with the reduced iron pellets from the furnace, but the residual fraction is squeezed into the rotary hearth surface by the discharging apparatus. The squeezed reduce iron powder is deposited on the rotary hearth surface without reoxidation. Reduced iron powder is further deposited during the rotation of the rotary hearth and gradually integrates with the previously reduced iron powder to form a layer of a large reduced iron plate.

According to the above U.S. patent, a mixture of iron ore, coal powder, and $SiO_2$ is heated at 1,300 to 1,400° C. on a base refractory to form a low-melting-point substance containing FeO and $SiO_2$, and then the furnace is cooled to form a semi-melted hearth, in order to mechanically discharge the reduced iron plate by a discharging apparatus and to facilitate heat transfer from the hearth to the iron oxide pellets.

Such a construction of the hearth inevitably requires a long preparatory period prior to furnace operation. Since the temperature range in which the hearth material can be present in a semi-melted state is around 1,150° C. and is narrow, the temperature of the hearth must be controlled to be uniform. When the temperature of the moving hearth is not uniform, the temperature is low at two ends of the moving hearth, and the hearth member is present in an unsticky solid state. Thus, the bulk hearth member separates when the reduced iron agglomerates are discharged by the discharging apparatus. When the surface of the moving hearth is cooled by radiative cooling from the discharging apparatus, the internal section of the hearth is hotter and more viscous than the cooled surface. Thus, the powder included in the agglomerates is squeezed into the internal section of the moving hearth from the surface. As a result, the powder forms a large reduced iron plate which cannot be easily discharged by the discharging apparatus. Furthermore, the powder is mixed with the hearth material composed of FeO and $SiO_2$ to cause an increased melting point of the hearth material. Thus, the semi-melted state of the hearth and thus the smoothness of the hearth surface cannot be maintained.

A possible alternative method to this process is construction of a shaped or amorphous refractory on the base refractory. The overlying refractory, however, may be damaged by thermal shocks. Furthermore, the construction of the shaped or amorphous refractory is performed by human-wave tactic and requires a long working period.

SUMMARY OF THE INVENTION

It is an object of the present invention to provide a method for producing reduced iron agglomerates in which a hearth member is easily constructed, has high durability, can maintain surface flatness, and is less altered.

A method for producing reduced iron agglomerates in accordance with the present invention includes the steps of supplying iron oxide agglomerates incorporated with carbonaceous material onto a moving hearth moving in a moving hearth furnace, reducing by heating the iron oxide agglomerates to form reduced iron agglomerates while the moving hearth moves in the moving hearth furnace, and discharging for collection the reduced iron agglomerates from the moving hearth furnace. The moving hearth is formed by sintering a hearth material primarily composed of iron oxide and constructed as a layer on a base refractory on the moving hearth. The sintered moving hearth is not melted at an operational temperature in a reducing step.

According to the present invention, the moving hearth is readily formed by sintering the hearth member constructed as a layer in the moving hearth furnace. This process is simpler than providing a shaped or amorphous refractory on the base refractory.

Since the hearth member is in a sintered solid state and is not melted at the operational temperature in the reducing step, the moving hearth has high durability and is usable repeatedly. Furthermore, the powder included in the agglomerates does not form a large reduced iron plate inhibiting discharge of the reduced iron agglomerates. The surface flatness of the moving hearth is easily maintained.

Since a hearth material primarily composed of iron oxide is used as a moving hearth, the hearth member and the main component to be reduced are composed of the same material. Thus, the alteration of the hearth member due to mixing of the powder from the iron oxide agglomerates does not occur. Since the hearth material is reduced in the reducing step, the metallic content in the reduced iron agglomerates as a product is not decreased even if the hearth member is separated from the moving hearth and is discharged from the moving hearth furnace.

Preferably, an intermediate layer comprising magnesium oxide is disposed between the base refractory and the hearth member.

Even if the hearth member is melted during the operation of the reducing step, the magnesium oxide intermediate layer avoids contact of the melted hearth member with the base refractory. Thus, shutdown due to damage of the hearth member will not occur.

Preferably, the hearth member is constructed by placing agglomerates of the hearth material onto the base refractory of the moving hearth and leveling the agglomerates of the hearth material into a layer.

In such a process, the construction of the hearth member can be easily and rapidly performed. Since general devices used in production of reduced iron agglomerates, such as a hopper for feeding iron oxide pellets, can be used in the construction of the hearth member, facility costs can be reduced. A leveler or a discharging apparatus used in production of general reduced iron agglomerates can be used in this leveling step.

Preferably, the hearth material comprises iron ore powder containing 1 to 8.5 percent by weight of water.

In this case, the hearth member is effectively constructed. A water content less than 1 percent by weight or more than 8.5 percent by weight causes excessively high dropping strength. Thus, the leveler or the like will not level the hearth material. In addition, the leveler will not break the agglomerates of the hearth material during the leveling operation.

Preferably, the hearth material further comprises a binder.

In such a case, agglomerates will be easily formed of the iron ore powder. Thus, the hearth material has superior handling properties and contributes to improved production efficiency.

Preferably, the moving hearth is hot-mended by covering the indented section formed on the moving hearth with agglomerates of the hearth material.

Since the moving hearth is mended by covering indented sections on the moving hearth with additional agglomerates of the hearth material, the smoothness on the moving hearth surface is readily maintained.

DESCRIPTION OF THE PREFERRED EMBODIMENTS

The preferred embodiments will be described with reference to the attached drawings.

Figure 1:
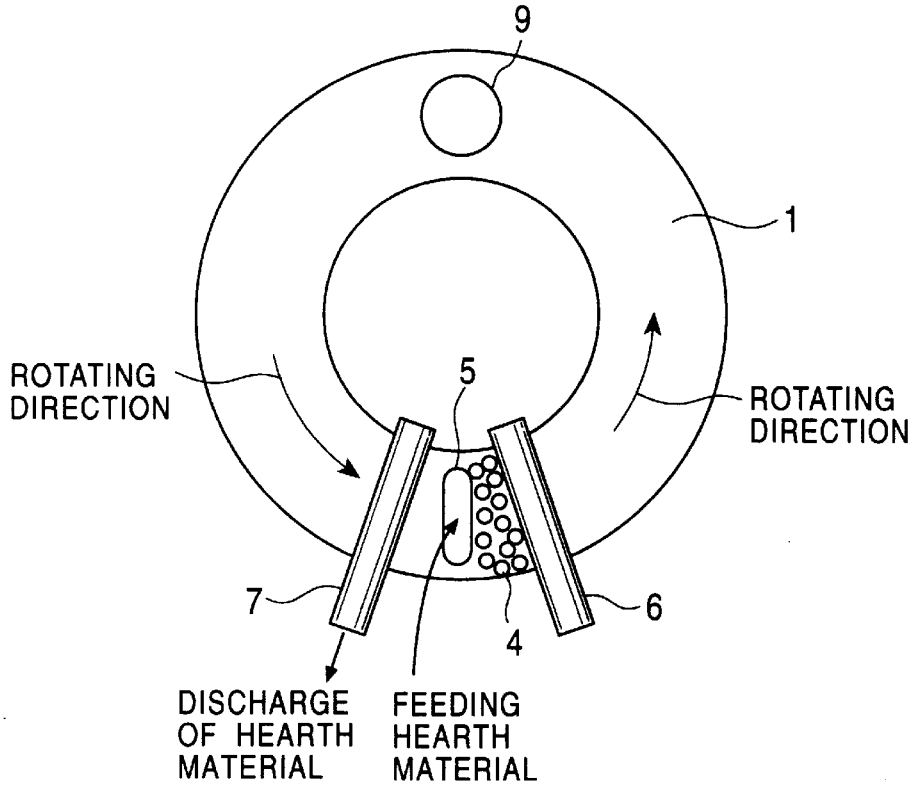
FIG. 1 is a top view of a moving hearth furnace used in a method for producing reduced iron in accordance with the present invention.
Figure 2:
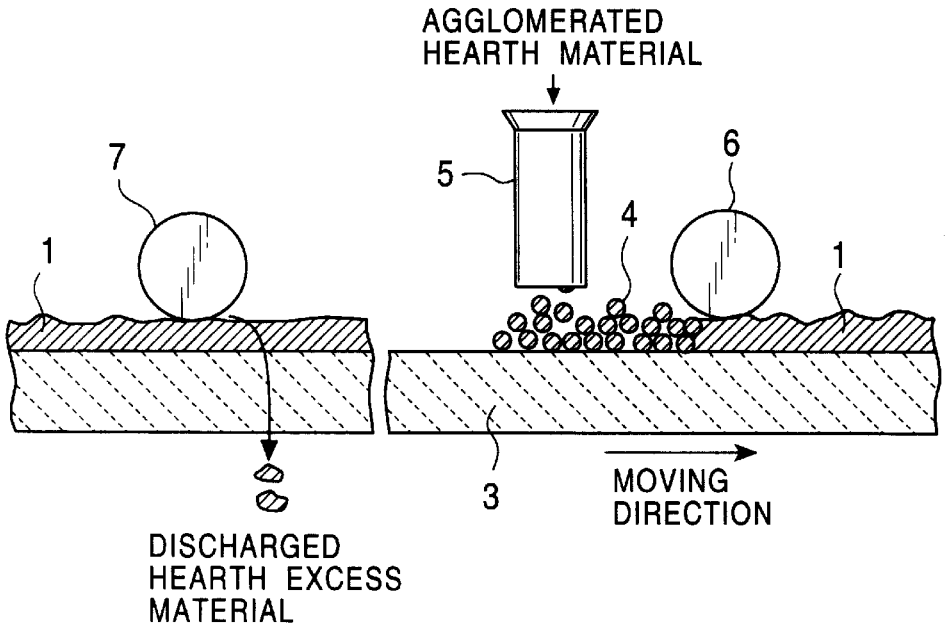
FIG. 2 is a front view of a main section of a moving hearth furnace used in a method for producing reduced iron in accordance with the present invention.
Figure 3:
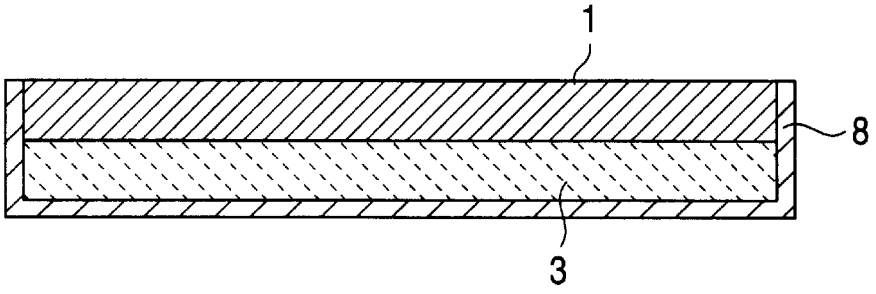
FIG. 3 is a cross-sectional view of a hearth member in accordance with the present invention directly constructed on a base refractory.

FIG. 1 is a top view of a reducing furnace used in a method for producing reduced iron in accordance with the present invention. FIG. 2 is a front view of a main section of a reducing furnace used in a method for producing reduced iron in accordance with the present invention. FIG. 3 is a schematic cross-sectional view of a hearth member in accordance with the present invention directly constructed on a base refractory.

The reducing furnaces shown in FIGS. 1 and 2 are rotary hearth furnaces having rotating hearths. In this embodiment, agglomerates of a hearth material 4 are fed onto a base refractory 3 constructed on a base member 8 of a moving hearth through a feeding hopper 5 which is provided for feeding iron oxide agglomerates or pellets. The hearth material 4 is composed of iron ore powder (iron oxide powder) containing a binder and water. The agglomerates of the hearth material 4 are uniformly distributed over the hearth in the width direction using a leveler 6 and are pressed so as to level the layer. Although pressing by the leveler 6 is not always necessary, the pressing facilitates the leveling of the layer. The excess hearth member 1 moves by one turn on the moving hearth and is then scraped off by a discharging apparatus 7 for discharging reduced iron pellets. The hearth member surface scraped off by a discharging apparatus 7 is further planarized. The layered hearth member 1 on the rotary hearth is heated by a burner etc., to an operational temperature in a range of 1,250 to 1,350° C. in the reducing step to form a porous solid sintered moving hearth. The leveler 6 is provided for uniformly feeding iron oxide pellets so as to have a given thickness in the width direction of the moving hearth. The base refractory 3 may be directly covered with powder of the hearth member without using the feeding hopper 5.

In this embodiment, the base refractory 3 is previously constructed on the base member 8 of the moving hearth, and the sintered hearth member 1 is constructed on the base refractory 3, as shown in FIG. 3.

In a conventional reducing step, iron oxide agglomerates or pellets are fed onto the hearth member 1 through the feeding hopper 5 and are leveled into a given thickness by the leveler 6. Since the iron oxide pellets are dried and hard, they are not crushed by the leveler 6. The pellets on the moving hearth are heated to 1,250 to 1,350° C. and are reduced by the carbonaceous material included in the iron oxide pellets to form reduced iron pellets while being moved in the furnace. Gas formed during the reduction reaction is discharged from the reducing furnace through a discharge duct 9. The reduced iron pellets are discharged as a product from the reducing furnace through the discharging apparatus 7.

The "agglomerates" in the present invention are, but not limited to, pellets and briquettes, and may include other shapes, for example, plates and bricks.

In a preferred embodiment of the present invention, a hearth member composed of iron oxide powder is constructed on a base refractory.

When an iron oxide powder containing at least 30% total iron is used as the hearth member constructed on the base refractory, the reducing furnace can be operated immediately after the construction of the hearth member. Such an iron content facilitates sintering of the powder during the heating process and a porous hard sintered hearth member is formed when the powder is heated to the operational temperature of 1,250 to 1,350° C. Since the iron oxide powder contains a small amount of gangue, diffusion bonding and slug bonding accelerate sintering when the powder is heated to 800° C. or more. Thus, a porous solid hearth, like a mass of sintered pellets, is formed. Accordingly, the reducing furnace can be operated immediately after iron oxide powder as a hearth member is distributed on the base refractory and is heated to an operational temperature of 1,250 to 1,350° C.

Since the iron oxide powder as the hearth member is a raw material of the iron oxide agglomerates (pellets or briquettes), the iron oxide powder is easily prepared.

Materials which are usable for the hearth member primarily composed of iron oxide include the above iron ore powder (iron oxide powder), mill scales, blast furnace dust, converter dust, sintered dust, electric furnace dust, and mixtures thereof.

Figure 4:
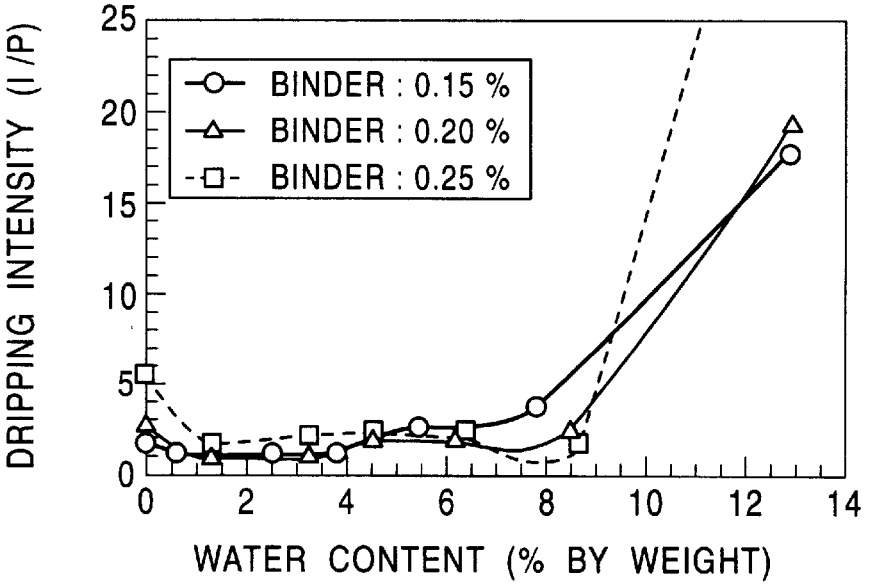
FIG. 4 is a graph of the relationship between the dropping strength and the water content in a hearth member of iron ore powder containing a binder in accordance with the present invention.

In order to prepare agglomerates from an iron oxide powder containing flour as a binder, 13 percent by weight of water is necessary. As shown in FIG. 4, however, a higher water content results in increased dropping strength, which inhibits leveling of the hearth surface by the leveler. Thus, the agglomerated hearth member is dried so as to decrease the water content to 8.5 percent by weight or less. Since the dropping strength also decreases when the water content is less than 1 percent by weight, the water content in the agglomerated hearth member is preferably in a range of 1 to 8.5 percent by weight. The average diameter of the agglomerated hearth member is 10 mm in such a case. It is preferable that the size of the agglomerated hearth member be in a range of 3 to 22 mm to avoid a decreased yield and problems due to restriction of a drying machine and a conveying facility.

Usable binders other than flour are known organic and inorganic binders. It is not always necessary to add the binder, although the addition of the binder is desirable.

Figure 5:
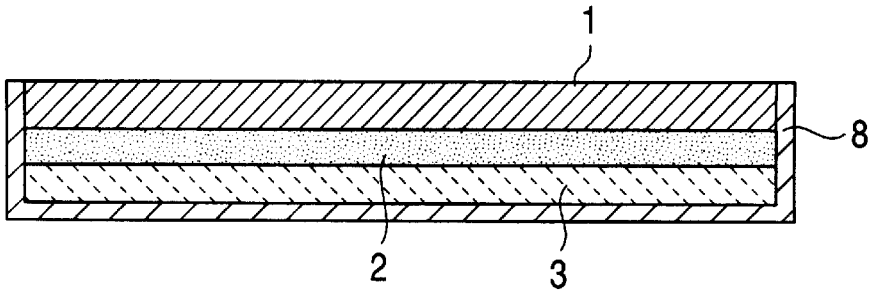
FIG. 5 is a cross-sectional view of a hearth member in accordance with the present invention which is constructed on a magnesium oxide intermediate layer formed on a base refractory.

With reference to FIG. 5, in another preferred embodiment in accordance with the present invention, an intermediate layer 2 primarily composed of magnesium oxide is formed on a base refractory constructed on a base member 8, and a hearth member 1 is constructed thereon.

Even if the hearth member 1 is melted due to extraordinary high temperature in the reducing furnace in this embodiment, the hearth member 1 reacts with the base refractory 3 so as not to damage the base refractory 3. That is, magnesium oxide has a high melting point of 2,800° C. and reacts with other refractory at an operational temperature, i.e., 1,300° C. so that a low-melting-point material is not formed. Even if the low-melting-point material is formed, the amount of the product is extremely low. Thus, the base refractory 3 is not damaged even if the hearth member 1 is melted and shutdown can be avoided. In addition, the service life of the moving hearth is prolonged.

The intermediate layer primarily composed of magnesium oxide is preferably formed of powder, granules, or agglomerates which are prepared by pulverizing magnesia clinker.

Figure 6:
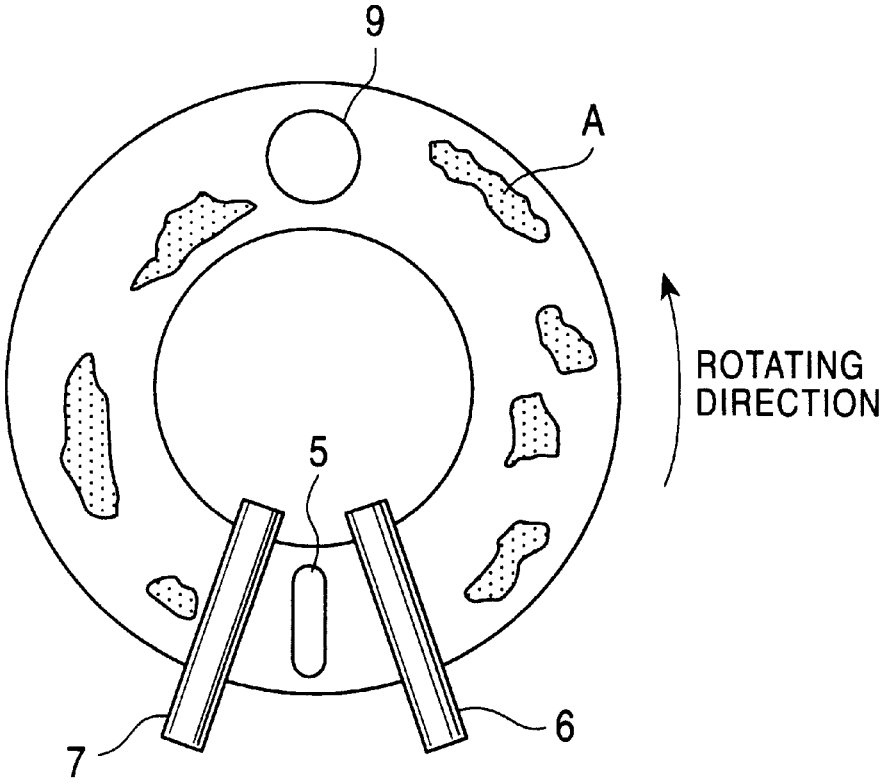
FIG. 6 is a top view of a moving hearth furnace used in a method for producing reduced iron in accordance with the present invention in which hot mending is performed.

An embodiment when hot mending is performed will now be described. FIG. 6 is a top view of a moving hearth furnace used in a method for producing reduced iron in accordance with the present invention in which hot mending is performed. In FIG. 6, parts with the same reference numerals as those in FIG. 1 have the same functions and will not be described in this embodiment.

Figure 7:
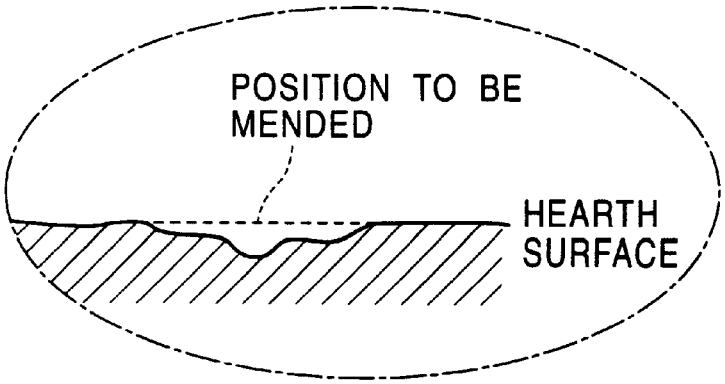
FIG. 7 is a schematic view for describing the necessity of hot mending in a method for producing reduced iron in accordance with the present invention.

When the reducing furnace is continuously used, separation of the hearth member 1 occurs to form indents A on the hearth member 1. The indents A result in deterioration of the flatness on the hearth member surface and adversely affects production of reduced iron pellets. When somewhat extensive indents A are formed, the indents A are filled with the hearth material 4 to repair the hearth. FIG. 7 schematically shows the indents A.

In FIG. 6, when predetermined rates of indents A are formed, the production of reduced iron agglomerates is suspended and hot mending of the hearth member is performed. In this embodiment, an agglomerated hearth material 4 is supplied from a feeding hopper 5 to cover the indents A and are distributed over the entire surface by a leveler 6 so as to protrude from the hearth by a height of +5 mm. The hearth surface is planarized by a discharging apparatus 7 at the position when the moving hearth rotates by one turn. The planarized hearth member 1 is sintered.

In this embodiment, mending is performed using the feeding hopper 5 and the leveler 6. A feeder and a leveling unit may be provided for exclusive use during the hot mending. For example, the agglomerated hearth member 1 may be fed from an opening provided on a side face of the moving hearth furnace. Mending may be performed by human-wave tactic of operators, without using these devices. Cold mending may be performed instead of the hot mending.

EXAMPLE 1

Bentonite as a binder was added to 800 to 1,500 $cm^2/g$ of iron ore powder as a hearth material and water was added so that the water content was 13 percent by weight. The mixture was shaped to agglomerates having an average diameter of 10 mm. With reference to FIG. 1, the agglomerates were fed onto the base refractory 3 (FIG. 3) in the furnace through the feeding hopper 5 and leveled by the leveler 6. The base refractory 3 was amorphous, was composed of 44 to 47% of $Al_2O_3$ and 35 to 44% of $SiO_2$, and had a thickness of 45 to 50 mm. Excess agglomerates 4 were discharged through a discharging screw of the discharging apparatus 7. The agglomerates 4 for the hearth material were crushed to form a uniform layer without voids of hearth member 1 when the agglomerates were leveled by the leveler 6. The hearth member 1 had a thickness of 50 nm. The reducing furnace was heated to vaporize water and was further heated to an initial operational temperature of 1,250 to 1,350° C. Table 1 shows the times required for the formation of the hearth from the start of the construction and the times for the COMPARATIVE EXAMPLE. The cold working time in Table 1 indicates a time for constructing the hearth member 1 on the base refractory, the heating time indicates a heating time to a temperature for forming the hearth, the hearth-forming time in the COMPARATIVE EXAMPLE indicates the sum of the melting time and solidifying time of the hearth material, and the total time indicates the time from the start of the cold working to the start of the operation.

The heating pattern of the hearth member 1 included heating to 200° C., holding the temperature for 3 hours for drying, and then heating to 1,300° C. at a heating rate of 50° C./hour.

In the COMPARATIVE EXAMPLE, iron ore, powdered coal as a reducing agent, and $SiO_2$ are mixed, and the admixture is heated to a temperature of 1,300° C. or more so that a hearth, which is composed of FeO and $SiO_2$ and has a low melting point by reductive melting, and is then cooled to less than the solidifying temperature. Thus, the total time for forming the hearth reaches 26.7 hours, as shown in Table 1. In contrast, the hearth member in EXAMPLE 1 is formed by sintering during the heating process to the operational temperature around 1,300° C. and no additional time for forming the hearth is required. Thus, the total time is decreased. Since the hearth member in EXAMPLE 1 is not softened at the operational temperature around 1,300° C. and has a uniform hardness in the width direction even when the temperature is not uniform. Thus, the discharging screw of the discharging apparatus does not squeeze reduced iron powder into the surface layer of the moving hearth. As a result, the discharging screw can scrape off the powder deposited on the moving hearth, without formation of a thick reduced iron plate or layer on the hearth. Since the hearth in EXAMPLE 1 is not formed by melting, cracks in the depth direction barely form. Thus, the hearth barely separates to form agglomerates when the discharging screw scrapes off an iron oxide layer formed by reoxidation of reduced powder, which is deposited on the moving hearth, during the cooling step. Since both the main component of the hearth material and the iron oxide agglomerate are iron oxide, alteration of the hearth member over time is decreased even when the powder from the iron oxide agglomerates is included In the hearth member.

TABLE 1

| | Hearth Material | Cold-working Time (Hours) | Heating Time (Hours) | Hearth-forming Time (Hours) | Total Time to Start of Operation (Hours) |
|---|---|---|---|---|---|
| COMPARATIVE EXAMPLE | $FeO \cdot SiO_2$ | 6 | 22 to 24 | 26.7 | 54.7 to 56.7 |
| EXAMPLE | Iron ore powder | 6 | 22 to 24 | — | 28 to 30 |

EXAMPLE 2

EXAMPLE 2 includes hot mending of the moving hearth having indents. The hearth member of EXAMPLE 2 is the same as that of EXAMPLE 1. The hot mending of the moving hearth surface was performed as follows. The hearth material was fed from the feeding hopper 5, and was leveled by the leveler 6. The excess hearth material was discharged from the furnace by the discharging screw of the discharging apparatus. The hot mending was performed when the flatness degree reached 80% in both EXAMPLE 2 and the COMPARATIVE EXAMPLE, wherein the flatness degree was defined as the ratio (by percent) of the total hearth area minus the total area of indents formed on the hearth to the total hearth area. The size of the maximum indents before hot mending was approximately 500 mm in diameter and 35 mm in depth. Table 2 shows the times required for filling the indents on the moving hearth with the hearth material during the hot mending.

In the COMPARATIVE EXAMPLE, the surface of the moving hearth is hot-mended by heating, reducing and melting the hearth material. Thus, a prolonged time is required for hot mending. In contrast, the operation in EXAMPLE 2 can restart when the hearth temperature reaches the operational temperature after the indents are covered with agglomerates of the hearth material. Thus, the mending time can be decreased.

Since the hot mending of the moving hearth must be performed in case of emergency, iron oxide pellets composed of iron ore powder and a carbonaceous material may be used, as it is. To the iron ore powder, 30% by weight or less of carbonaceous material can be added. In such a case, the burner is ignited in an air ratio of 0.6 or more, so as to form the hearth without reduction of the iron ore powder.

TABLE 2

| | Hearth Material | Hot-working Time (Hours) | Hearth-forming Time (Hours) | Total Time to Start of Operation (Hours) |
|---|---|---|---|---|
| COMPARATIVE EXAMPLE | $FeO \cdot SiO_2$ | 1 | 3 | 4 |
| EXAMPLE | Iron ore powder | 1 | — | 1 |

EXAMPLE 3

In EXAMPLE 3, an intermediate layer 2 primarily composed of magnesium oxide was formed on the base refractory 3 and the hearth member 1 was constructed thereon. Water was added to pulverized magnesia clinker having a magnesium oxide content of 94% or more and an average particle size of 8 mm to form mortar and the mortar was applied onto the base refractory 3 to form the intermediate layer 2 having a thickness of 50 mm. The hearth member 1 was constructed on the magnesium oxide intermediate layer 2, as in EXAMPLE 1. The reducing furnace was heated to dry the intermediate layer 2 and the hearth member 1, and heating was continued to sinter the heath member 1. The dried magnesium oxide intermediate layer is present in a state in which the material is physically cemented by evaporation of water.

The resulting hearth consists of the base refractory 3, the magnesium oxide intermediate layer 2 formed thereon, and the hearth member 1 formed thereon. Even if the hearth member 1 is melted by any effect during the operation, the magnesium oxide intermediate layer 2 functions as a barrier for preventing the formation of a low-melting-point material due to reaction of the melted hearth material with the base refractory 3 and thus deterioration of the base refractory 3.

Although the above embodiments use rotary hearth reducing furnaces, any other type of reducing furnace may be used. For example, a reducing furnace in which a linear moving hearth rotates like a belt conveyor may be used.

What is claimed is:

1. A method for producing reduced iron agglomerates comprising the steps of:

supplying iron oxide agglomerates incorporated with carbonaceous material onto a moving hearth moving in a moving hearth furnace, wherein the moving hearth is formed by sintering a hearth material primarily composed of iron oxide and constructed as a layer on a base refractory on the moving hearth, and is present in a semi-melted state at an operational temperature in a reducing step;

reducing by heating the iron oxide agglomerates to form a reduced iron agglomerates while the moving hearth moves in the moving hearth furnace; and discharging for collection the reduced iron agglomerates from the moving hearth furnace.

2. A method for producing reduced iron agglomerates according to claim 1, wherein an intermediate layer comprising magnesium oxide is disposed between the base refractory and the hearth member.

3. A method for producing reduced iron agglomerates according to claim 1, wherein the hearth member is constructed by placing agglomerates of the hearth member onto the base refractory of the moving hearth and leveling the agglomerates of the hearth member into a layer.

4. A method for producing reduced iron agglomerates according to claim 3, wherein the hearth member comprises iron ore powder containing 1 to 8.5 percent by weight of water.

5. A method for producing reduced iron agglomerates according to claim 4, wherein the hearth member further comprises a binder.

6. A method for producing reduced iron agglomerates according to claim 3, wherein the moving hearth is hot-mended by covering the indented section formed on the moving hearth with agglomerates of the hearth member.

7. A method for producing reduced iron agglomerates comprising the steps of: supplying iron oxide agglomerates incorporated with carbonaceous material onto a moving hearth moving in a moving hearth furnace; reducing by heating the iron oxide agglomerates to form reduced iron agglomerates while the moving hearth moves in the moving hearth furnace; and discharging for collecting the reduced iron agglomerates from the moving hearth furnace, wherein the moving hearth is formed by sintering a hearth material primarily composed of iron oxide and constructed as a layer on a base refractory on the moving hearth, and is present in a semi-melted state at an operational temperature in the reducing step.

* * * * *

UNITED STATES PATENT AND TRADEMARK OFFICE

CERTIFICATE OF CORRECTION

PATENT NO. : 6,254,665 B1
DATED : July 3, 2001
INVENTOR(S) : Matsushita et al.

It is certified that error appears in the above-identified patent and that said Letters Patent is hereby corrected as shown below:

Title page,
Item [73] and [30], the Assignee and Foreign Priority information are listed incorrectly.

Item [73] should read:

-- [73] Assignee: Kabushiki Kaisha Kobe Seiko Sho (Kobe Steel, Ltd.), Kobe (JP) --

Item [30] should read:

-- [30] Foreign Application Priority Data

Nov. 4, 1998 (JP) ..... 10-313202 --

Signed and Sealed this

Seventeenth Day of December, 2002

JAMES E. ROGAN
*Director of the United States Patent and Trademark Office*